US006203102B1

(12) United States Patent
Helmsderfer et al.

(10) Patent No.: US 6,203,102 B1
(45) **Date of Patent: *Mar. 20, 2001**

(54) CHILD SUPPORT DEVICE WITH SLIDABLE SEAT ELEMENT

(76) Inventors: John A. Helmsderfer, 2151 Luray Ave., Cincinnati, OH (US) 45206; Greg Lee, 9226 Glenwood Trail, Brecksville, OH (US) 44141

( * ) Notice: Subject to any disclaimer, the term of this patent is extended or adjusted under 35 U.S.C. 154(b) by 0 days.

This patent is subject to a terminal disclaimer.

(21) Appl. No.: 09/435,513

(22) Filed: Nov. 8, 1999

Related U.S. Application Data

(63) Continuation of application No. 09/025,428, filed on Feb. 18, 1998, now Pat. No. 6,074,007.

(51) Int. Cl.[7] ..... A47D 1/00

(52) U.S. Cl. ..... 297/130; 297/118; 297/335; 297/237; 297/236; 297/236.16

(58) Field of Search ..... 297/130, 118, 297/134, 236, 237, 236.16, 335, 256.13

(56) References Cited

U.S. PATENT DOCUMENTS

D. 387,583 * 12/1997 Shear .
1,267,800 * 5/1918 Peterman .
2,058,299 * 10/1936 Cook .
2,063,046 * 12/1936 Naturkacz .
2,244,096 * 6/1941 Brazell .
2,717,633 * 9/1955 Hartmann .
2,731,072 * 1/1956 Post .
3,427,069 * 2/1969 McDonald .
4,065,175 * 12/1977 Perego .
4,743,063 * 5/1988 Foster, Jr. .
4,768,827 * 9/1988 Musgrove .
5,248,181 * 9/1993 Efthmiou .
5,421,636 * 6/1995 Gamble .
5,470,039 * 11/1995 Hilger .
5,527,096 * 6/1996 Shimer .
5,564,778 * 10/1996 Shimer et al. .

OTHER PUBLICATIONS

Cosco, Inc., *Cosco Commercial Contract Products—Youth Seating*, Cosco Sales Brochure for Model 03–341 High Chair.*

American Infant Care Products, *Tot & Toddler Chair*, undated sales flyer.*

* cited by examiner

*Primary Examiner*—Anthony D. Barfield
(74) *Attorney, Agent, or Firm*—Wood, Herron & Evans, LLP

(57) ABSTRACT

A multi-purpose child support device comprises a frame having a base for placement on a floor surface and a support section positioned above said base. A seat element is configured for receiving a toddler child in a sitting position and engaging the support section above the floor surface to form a high chair. The seat element is pivotally mounted to the frame and is operable for being selectively pivoted away from the support section such that the support section receives an infant child carrier for supporting an infant child carrier above a floor surface.

9 Claims, 2 Drawing Sheets

CHILD SUPPORT DEVICE WITH SLIDABLE SEAT ELEMENT

RELATED INVENTIONS

This patent application is a continuation application of U.S. patent application Ser. No. 09/025,428, filed on Feb. 18, 1998, and now issued as U.S. Pat. No. 6,074,007.

FIELD OF THE INVENTION

This invention relates to the physical support of a child and specifically to a device for supporting children of different ages in a restaurant atmosphere.

BACKGROUND OF THE INVENTION

When families go to a restaurant or other similar facility for dining, they often include small children. The children may be small toddlers or even smaller infants. Therefore, for a pleasurable dining experience for the entire family, and particularly for the adults of the party, the small children must be properly and safely accommodated at the table.

While larger children are often able to sit in regular adult chairs, some with the aid of a traditional booster seat, the smaller toddler and infant children require special arrangements. For example, traditional high chairs have long been available for toddler children who are able to sit up on their own, but who are yet too small to sit in an adult chair, even with a booster seat. Furthermore, high chairs are particularly suitable for rambunctious toddlers for whom a certain amount of containment is desired during a meal. High chairs provide certain restraints, such as belts, for a child placed therein, and therefore, provide peace of mind for the parents or caregivers during the meal. Additionally, the seating platform for the toddler child is generally smaller than in an adult chair, thereby helping the child to remain in an upright position.

While traditional high chairs have been suitable for toddler children who can sit on their own, they are entirely inadequate for infant children who do not yet have the motor skills to do so. Infants are generally brought to restaurants in an infant carrier, often referred to as a "pumpkin seat." Infant carriers usually include a cradle-shaped base for comfortably carrying or supporting the infant. A pivoting handle is attached to the base so an adult may manipulate the carrier. When dining with an infant child, parents often have to place the infant carrier and infant on the table, on a chair (if large enough) or on the floor. All of those available options for placement of the infant carrier are undesirable. Not only is the carrier exposed to chances of falling, but oftentimes there is not sufficient table space for safely placing the infant carrier thereon. Furthermore, a chair may be too small to accommodate the carrier. Even if the chair is large enough, the awkward and cumbersome shape of infant carriers often requires that the chair and carrier be wedged against the table to ensure that the carrier does not fall off of the chair. This can present a precarious and, therefore, dangerous situation for the infant. Finally, placing the infant and carrier on a dirty, drafty restaurant floor is certainly an option to be avoided, even though it is often the safest of the available options.

One option, but one which is dangerous and discouraged or prohibited by many restaurants, is to turn a traditional high chair structure upside-down and place the infant carrier in the wide base of the chair. In doing so, the chair rests on the very narrow seat portion. Therefore, the upside-down chair is very likely to fall, which could injure a baby placed thereon. Furthermore, the restaurant could be exposed to legal liability for an injured child. While such an option is discouraged, parents will still choose to do so, and restaurants will allow them for the purposes of accommodation or lack of a more suitable option.

Attempts have also been made to develop a support device specifically for infant carriers. Many such structures are expensive and complicated and are only adapted to a specific carrier design. If a restaurant does not have a specific device for the family's infant carrier, the parents have to carry their own support device. As may be appreciated, it is very inconvenient and time-consuming to have to transport and set up such a device in a restaurant.

One type of device for supporting a variety of different infant carriers consists of a sling stretched between two support elements. The sling forms a hammock to receive the carrier. Such a device is usually suitable for the purpose of supporting the carrier above the floor, regardless of the shape of the carrier. However, such devices must be purchased and maintained by a restaurant in addition to their other separate high chair devices.

Another commercially available product purports to be suitable for both infants and toddlers. Essentially, the product is a traditional high chair which can recline for cradling an infant. However, such a product requires that the infant be removed from its carrier and placed in the plastic seat of the product. For a parent, such a scenario is not desirable. First, the plastic seat is hard and cold, and may even be dirty. Personal infant carriers usually have cushions on which the baby rests and the parents know that their carrier is clean. Therefore, the parents will be reluctant to switch the baby from their personal carrier to a public high chair device. Secondly, the infant may be nestled in blankets and other such covers, and may even be sleeping. Having to wake the infant and/or move all of the blankets to the public high chair device would further deter use of such a product. Finally, the parents or the restaurant staff are left with trying to store the bulky, empty infant carrier during the meal.

Therefore, it would seem that the only practical option for accommodating all ages of children is to maintain a large number of dedicated infant carrier support devices. A significant drawback, however, to any dedicated infant carrier support device, is that the restaurant must keep a number of such devices on hand, and also must obtain separate high chair structures for toddler children, and booster seats for older children. Available infant carrier support devices and high chairs are large and bulky, and therefore, require a substantial amount of valuable restaurant floor space. While some high chair structures are stackable, infant carrier support devices generally are not.

Another drawback to maintaining a large number of such devices is the additional purchase and replacement costs for the devices. However, restaurants, and particularly family-type restaurants, desire to keep their family patrons not only satisfied, but also comfortable with the thought that their children will be safe during the dining experience. Therefore, they must assume the cost of purchasing and maintaining a large number of different devices to do so.

Another drawback to having a large number of separate high chairs and infant carrier support devices, is the cleaning required for such structures. Food is usually splattered all over by toddler children and may also be splattered by older infant children. Of course, parents do not want to place their child in a high chair or other device which is still dirty from the previous child. Therefore, the work loads of waitpersons, buspersons, and hosts are all increased to ensure clean high chairs and infant carrier support devices.

Therefore, it is one objective of the invention to accommodate dining families so that their children of all ages are safe and secure during the meal.

It is another objective of the invention to accommodate both toddler children and infant children during dining.

It is still another objective of the invention to reduce the costs to the restaurant owner and the work loads of the staff associated with such accommodation.

It is another objective of the invention to safely provide support to a child during a meal which is above the floor and off of the table.

Still further, it is an objective to provide such accommodation in a safe manner to reduce the liability exposure of a restaurant owner.

SUMMARY OF THE INVENTION

The above-listed objectives and other objectives are addressed by the present invention which provides a multi-purpose child support device which can accommodate both a toddler child as well as an infant child who is resting in an infant carrier. The multi-purpose child support device of the present invention supports children of both toddler and infant age so that they are safe and secure during the meal. The child is supported above the floor and off of the table at a relatively low cost to the restaurant owner. Furthermore, since a single device is used for both toddler and infant children, the purchase and maintenance costs to the restaurant owner are reduced and the work loads of the various staff persons in the restaurant are also reduced. The safety of the device reduces the liability exposure of the restaurant owner.

The inventive child support device may be switched between a toddler mode and an infant mode and includes a frame having a relatively wide base which is placed on a floor surface and a support section above the base, for supporting the child. A seat element is configured for receiving a toddler child in the sitting position, and the seat element engages the support section of the frame above the floor surface for forming a high chair for a toddler child. Like a traditional high chair, the toddler child is maintained in a seated and upright position so that they may eat at a table and interact with other children and adults sitting at the table.

In the infant mode, the inventive child support device is adaptable for receiving an infant child carrier when a child with the family is too young to be able to sit up on their own and thus must remain resting in the infant carrier during the meal. To that end, the seat element is pivotally mounted to the frame and is operable for being selectively pivoted away from the support section. The support section, in turn, is configured to receive an infant carrier when the seat element is pivoted away therefrom, and is further operable for safely supporting the infant carrier above the floor surface.

In a preferred embodiment of the invention, the frame includes side members which have U-shaped portions with open upper ends for receiving the infant child carrier. As will be understood by a person of ordinary skill in the art, the portions might also be characterized as C-shaped, depending upon how much of a cut-out section is provided at the top of the frame side members. The open ended, U-shaped portions of the side members form part of the support section of the frame and provide accommodation for the handle of the infant carrier so that the infant carrier rests securely in the support section. Preferably, the seat element is pivotally mounted to the frame within an elongated slot or channel which allows the seat element to be pivoted away from the upper support section and also slid downwardly on the frame to be suspended below the support section when the infant carrier is placed therein. To convert the child support device back to a high chair, or the toddler mode, the seat element is simply pivoted and slid upwardly and back into the support section.

The seat element includes a portion of the frame coupled thereto so that when in the toddler mode or high chair form, the U-shaped portion of the frame is modified to provide a completed look to the frame. Preferably, the frame is wood, plastic or metal, while the seat element is a suitable plastic material which may be easily wiped and cleaned.

The base of the device is larger than the support section for stabilizing the frame on a ground surface. Horizontal cross members spanning between the side members of the frame in the support section engage bottom and side surfaces of the infant carrier for supporting the carrier in an upright position when placed in the support section. Furthermore, the horizontal cross members engage indentations formed in the seat element for further stabilizing the seat element within the frame when the device is in the high chair form.

The inventive device thus provides a single child support device which safely accommodates children of all ages, including infant children within a carrier. The safety provided by the device reduces a restaurant owner's liability exposure. Restaurants only have to purchase one device to accommodate all children and thus do not have to maintain separate infant carrier support devices as well as traditional high chairs. Also, restaurant staff only have to maintain a single structure for all children. The inventive device provides a safe and secure place for children during dining. Furthermore, the inventive device in the infant carrier form may be utilized for supporting an infant carrier while parents wait to be seated at a table. This eliminates the need for a parent to hold the heavy infant carrier for a long period of time or place the infant carrier on a cold and dirty ground surface. Still further, a substantial amount of valuable restaurant space is conserved by eliminating separate high chair and infant carrier support devices.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
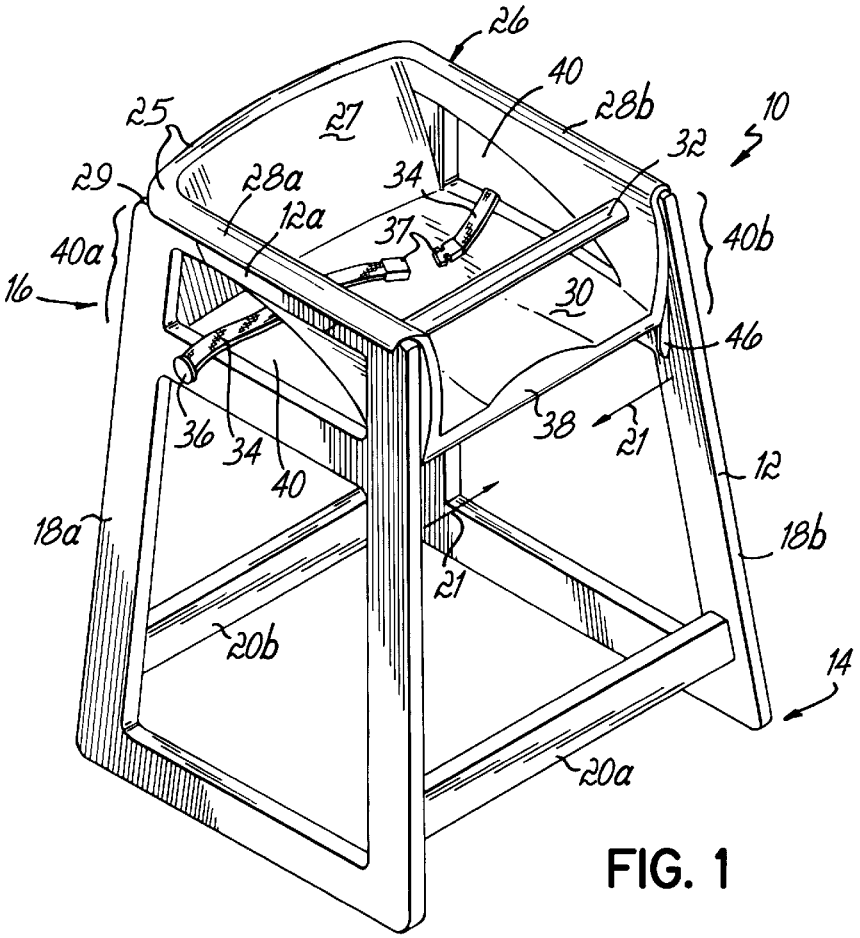
FIG. 1 is a perspective view of the inventive child support device.

FIG. 1 shows one embodiment of the child support device of the present invention in the toddler mode for supporting a toddler child. Child support device 10 includes a frame 12 having a base 14 and a support section 16 positioned above the base. Frame 12 includes two side members 18*a*, 18*b* which taper in their width dimension W from base 14 up to the support section 16. In the base of frame 14, horizontal cross members 20*a*, 20*b* extend between the two side members 18*a*, 18*b*. The wide bottom portions of the side members 18*a*, 18*b* and the cross members 20*a*, 20*b* collectively form the base 14 of frame 12. The side members 18*a*, 18*b* taper inwardly proceeding from the base 14 to the support section 16 to have a generally triangular shape. Furthermore, as illustrated in FIG. 1, the side members are tilted inwardly in the direction of arrows 21 such that the cross-sectional dimension of the frame base 14 is larger than the cross-sectional dimension of the support section 16. In that way, the wide base 14 provides a suitable platform for supporting a child in the child support device 10. In support section 16, additional cross members 22*a*, 22*b* extend between the side members 18*a*, 18*b* for further securing the various members together to form the device frame 12. In a preferred embodiment of the invention, frame 12 is made of wood to give a warm and appealing appearance to a restaurant patron. The various frame elements may be held together by glue, nails, or any other suitable fastening structures.

In accordance with the principles of the present invention, device 10 further includes a seat element 26, which includes a back 27, two sides 28*a* 28*b*, and a seat surface 30. The seat element is configured for receiving a toddler child (not shown) in a sitting position. Seat element 26 might also include a cross-bar 32 to prevent the child from sliding forward and out of the seat element. As illustrated in FIG. 1, the seat element engages the support section 16 of frame 12 above the base and above a floor surface on which the base rests. In that way, the invention in the form illustrated in FIG. 1 forms a high chair for a toddler child. Preferably, seat element 26 is formed of a suitable plastic material which may be easily cleaned after each use. In a preferred embodiment, safety straps 34 are coupled to frame 12 by a suitable fastener 36. The safety straps may be wrapped around the waist and legs of a toddler child sitting in the seat element 26 to further secure the child in the high chair structure To that end, the safety straps 34 include a buckle 37, or other suitable fastening structure, such as hook and loop fasteners, for coupling the two safety straps 34 together across the legs and/or waist of the child. The seat surface 30 of seat element 26 may be conformed to the seat and legs of a child, such as by placing a raised portion 38 in the seat surface 30. Suitable side openings 40 in the seat element 26 allow the safety straps 34 to extend inwardly to the seat surface 30 for securing the toddler child in the seat element 26.

Figure 2:
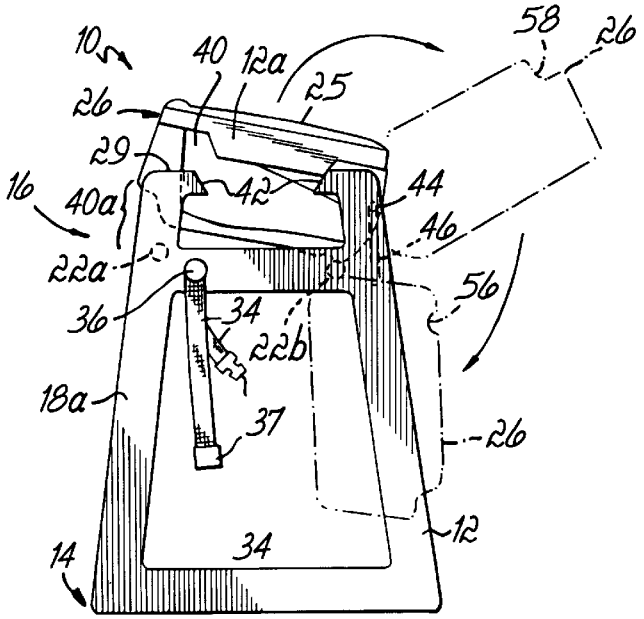
FIG. 2 is a side view of the inventive device showing removal of the seat element from the support section.
Figure 3:
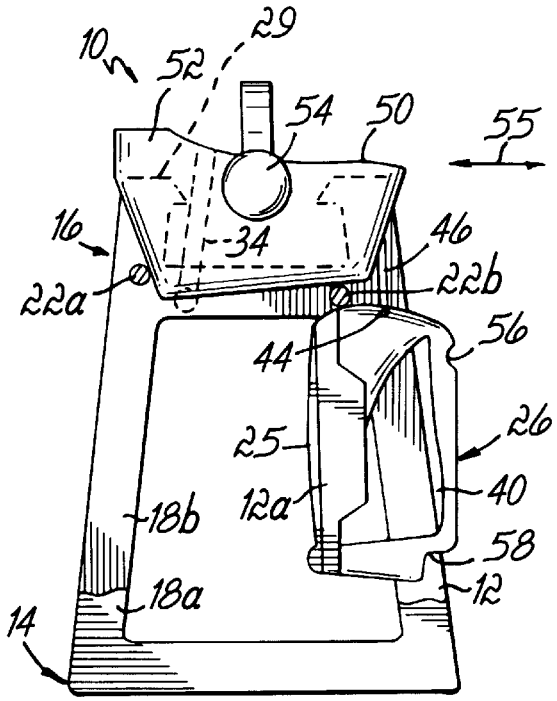
FIG. 3 is a side view showing an infant carrier supported by the inventive device after removal of the seat element.

As seen in FIGS. 1, 2, and 3, seat element 26 has an upper annular flange 25 which sits on an upper edge 29 of the frame support section. The seat surface 30 rests on cross members 22*a*, 22*b*.

Turning to FIG. 2, seat element 26 includes portions 12*a* of the frame coupled thereto around the top edge of the seat element. Specifically, frame portions 12*a* are coupled to the side sections of the annular flange 25 as shown in FIG. 2. The seat element 26 is moveably mounted with respect to frame 12, as discussed further hereinbelow, and when the seat element 26 is engaged by the support section 16, as shown in FIG. 1, the support section 16 is configured to receive the frame portions 12*a* to form a completed frame 12.

Referring to FIG. 2, the vertical side members 18*a*, 18*b* include portions 40*a*, 40*b* which have an open upper end 42 provided by a cut-out section of the side members. The portions 40*a*, 40*b* could be characterized as U-shaped or C-shaped, depending upon how much of a cut-out section is provided. The portions 40*a*, 40*b* of the side members 18*a*, 18*b* form part of the support section 16 of the frame 12. When the seat element 26 is received by the support section 16, the frame portions 12*a* attached thereto are received by the U-shaped portions, generally at the upper end thereof, to close the open end 42 and provide a completed frame as shown in FIG. 1. The frame portions 12*a* which are secured to the seat element 26 such as by glue or appropriate fasteners (not shown), further align the seat element 26 within the support section 16 for a sturdy construction and for securing the seat element 26 to the frame 12. Additionally, when in the toddler mode or high chair form, as shown in FIGS. 1 and 2, the frame portions 12*a* interact with the portions 40*a*, 40*b* and provide the appearance of a solid frame structure.

Seat element 26 preferably includes suitable indentations 56, 58 on the bottom side of seat surface 30 which receive the cross members 22*a*, 22*b* when the seat element 26 is seated within support section 16 as illustrated in FIG. 2. In that way, the indentations further help to secure the seat element 26 within support section 16 so that the seat element does not slide around or rattle on the frame 12 of device 10.

In accordance with the principles of the present invention, the seat element is movably mounted to frame 12 so that the device 10 may be converted to the infant mode. More specifically, the seat element is pivotably mounted to the frame 12, and to that end includes a pivot axis 44 which engages an aperture 46 formed in the frame, and specifically, formed at a front end thereof on the inside of the side members 18*a*, 18*b*. As illustrated in FIG. 2, the seat element may be pivoted on axis 44 out of and away from the support section 16, and more specifically, out of and away from the portions 40*a*, 40*b* of the side members 18*a*, 18*b*. Seat element 26 pivots at one end out of the support section and is suspended below the support section 16 by frame 12. In that way, the seat element is moved out of the way and the device 10 of the invention is now in a form for supporting an infant child carrier, as illustrated in FIG. 3. The pivot axis 44 in slot 46 suspends the seat element from frame 12.

In a preferred embodiment of the invention, aperture 46 is formed in the shape of an elongated slot such that the axis 44 of seat element 26 may not only pivot within the slot 46, but also slides down the length of the slot to its bottom-most end. In that way, as shown in FIG. 3, the seat element 26 may be moved completely out of the way of the support section 16 to hang below the support section so as not to hinder or obstruct the use of device 10 with an infant carrier 50. Axis 44 may be formed of metal or plastic or any suitable material which is rigid enough to support the weight of seat element 26 after it has been moved away from the support section 16 of frame 12. In the form as illustrated in FIG. 3, the portions 40*a*, 40*b* are exposed and the support section 16 is configured to receive an infant child carrier 50 to support the infant child carrier 50 and an infant therein above a floor surface on which base 14 rests. Infant child carriers 50, also commonly referred to as "pumpkin seats," generally include a cradle section 52 and a pivoting handle 54. The portions 40*a*, 40*b* of frame 12, and specifically the open upper ends 42 of the portions, accommodate the handle 54 to thereby prevent child carrier 50 from sliding forward and backward in the direction of arrow 55. The cross members 22*a*, 22*b* support the bottom and side surfaces of the infant child carrier 50 so that when placed in the device 10, the infant child carrier is generally in an upright position, as illustrated in FIG. 3. Finally, the side member portions 40*a*, 40*b* essentially prevent carrier 50 from sliding side-to-side in frame 12. Of course, slight movement of the carrier in a particular direction is acceptable as long as the carrier does not slide off of the frame.

If desired, the safety straps 34 might be wrapped around the infant child carrier to further secure it to device 10. To that end, the safety straps are dimensioned in length to do so. However, the weight of the infant child carrier 50 and infant is generally suitable for securely maintaining the carrier within the support section 16 of device 10.

While a preferred embodiment of the present invention utilizes portions 40*a*, 40*b* which have open upper ends 42 for accommodating the handle 54 of carrier 50, a support section without an open upper end might also be utilized wherein the top of the support section extends, unbroken, completely across the top of the frame, similar to the illustration in FIG. 1, without a separate frame portion 12*a* on the seat element 26. That is, the handle may simply rest on a top edge of the frame, rather than being received by and within the frame as illustrated in the Figures.

Figure 4:
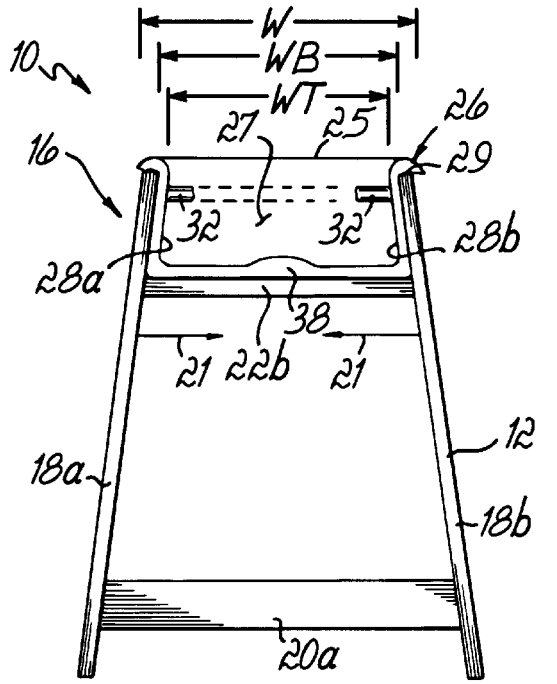
FIG. 4 is a front schematic view of the inventive device.

For easy movement of seat element 26, the seat element is preferably dimensioned to be no wider at its base than at its top. Referring to FIG. 4, a schematic front view of the invention is shown wherein the inward tilt of the side members 18*a* is shown along lines 21. The support section 16 of frame 12 has its narrowest or minimum width W at the top thereof due to the inward tilt of the side members 18*a*. The seat element preferably has a base width $W_B$ which is no greater than the top width $W_T$. The maximum width $W_T$ of the top of seat element 26 is less than width W. In that way, the seat element 26 may be easily lifted, tilted or slid out of the support section 16 without catching on a portion of the frame 12.

The inventive device 10 thus provides a single child support device which may accommodate children of all ages, including infant children within a carrier and toddler children. Restaurants only have to purchase one device to accommodate all children and thus do not have to maintain separate infant carrier structures as well as traditional high chairs. The inventive device provides a safe and secure place for children during dining. Furthermore, the inventive device, in the infant carrier form, may be utilized for supporting an infant carrier while parents wait to be seated at a table. This eliminates the need for a parent to hold the heavy infant carrier for a long period of time, or to place the infant carrier on a cold and dirty ground surface. Still further, the dual function of the invention conserves a substantial amount of valuable restaurant space which is usually dedicated to separate high chair and separate infant carrier support structures. The invention safely and securely supports an infant carrier and eliminates the need for a restaurant customer to dangerously flip a traditional high chair structure to place the infant carrier in the wide base thereof. As such, the present invention will limit the liability exposure of restaurants.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A multi-purpose child support device for selectively acting as a high chair or a support for an infant child carrier comprising:

a frame having a base adapted to be positioned on a floor surface and a support section positioned above said base;

a seat element having a back and seat surface and configured for receiving a toddler child in a sitting position, the seat element being seated and contained within the support section above the base and being supported by the support section for forming a high chair for a toddler child;

the seat element and the back and seat surface being pivotally mounted to the frame and operable for being selectively pivoted out of and away from the support section while the support section remains in place;

the support section, with the seat element pivoted away therefrom, being configured for receiving and containing an infant child carrier and operable for supporting an infant child carrier above a floor surface;

wherein the device may be selectively utilized for supporting children of various ages.

2. The child support device of claim 1 wherein said frame support section comprises vertical side members and at least one horizontal cross member to contain the seat element, the cross member engaging a bottom surface of an infant child carrier for supporting the carrier in an upright position when the seat element is pivoted away from the support section.

3. The child support device of claim 1 wherein the support section comprises vertical side members which include portions having an open upper end for receiving an infant child carrier.

4. The child support device of claim 1 wherein said seat element includes a portion of the frame coupled thereto, the support section being configured to receive said frame portion when the seat element engages the support section.

5. The child support device of claim 4 wherein said frame is formed of wood, the frame portion coupled to the seat element being formed of wood and creating a completed look to the frame when the seat element engages the support section.

6. The child support device of claim 1 wherein said seat element includes a pivot axis element operably coupled to the frame for pivotally mounting the seat element thereto.

7. The child support device of claim 1 further comprising a slot, the seat element movably coupled with the slot for sliding on the frame when pivoted away from the support section.

8. The child support device of claim 1 wherein said base has a cross-sectional dimension larger than the cross-sectional dimension of the support section for stabilizing the frame on a ground surface.

9. The child support device of claim 1 wherein said support section has a minimum width, a widest width dimension of said seat element being less than said support section minimum width for providing easy movement of the seat element with respect to said support section.

* * * * *